US010337798B2

(12) United States Patent
Rainey, Jr. et al.

(10) Patent No.: US 10,337,798 B2
(45) Date of Patent: Jul. 2, 2019

(54) INJECTION LANCE SHIELD FOR METAL PRODUCTION FURNACE

(71) Applicants: Michael A. Rainey, Jr., Apple Grove, WV (US); Dennis Beller, Gallipolis Ferry, WV (US)

(72) Inventors: Michael A. Rainey, Jr., Apple Grove, WV (US); Dennis Beller, Gallipolis Ferry, WV (US)

( * ) Notice: Subject to any disclaimer, the term of this patent is extended or adjusted under 35 U.S.C. 154(b) by 138 days.

(21) Appl. No.: 15/594,241

(22) Filed: May 12, 2017

(65) Prior Publication Data

US 2018/0328666 A1 Nov. 15, 2018

(51) Int. Cl.
*F27D 3/16* (2006.01)
*F27B 3/18* (2006.01)

(52) U.S. Cl.
CPC ..... *F27D 3/16* (2013.01); *F27B 3/18* (2013.01); *F27D 2003/168* (2013.01)

(58) Field of Classification Search
CPC ..... F27B 3/18; F27D 2003/168; F27D 3/16
USPC ..... 266/271, 225, 216, 217; 75/10.4, 10.46, 75/569, 561, 373
See application file for complete search history.

(56) References Cited

U.S. PATENT DOCUMENTS 4,077,614 A * 3/1978 Udo ..... C21C 5/5217 266/159
6,289,035 B1 9/2001 Shver
6,614,831 B2 9/2003 Shver
6,805,724 B2 10/2004 Shver
6,999,495 B2 * 2/2006 Popenov ..... C21C 5/5217 373/60
7,483,471 B2 1/2009 Shver
7,491,360 B2 2/2009 Shver
7,824,604 B2 11/2010 Higgins et al.
7,858,018 B2 12/2010 Shver
7,951,325 B2 5/2011 Higgins et al.
8,003,043 B2 8/2011 Shver
8,142,711 B2 * 3/2012 Glass ..... C21C 5/5217 266/241
8,277,721 B2 10/2012 Shver
8,520,714 B2 8/2013 Higgins
9,068,779 B2 6/2015 Eyfa
2007/0058689 A1 * 3/2007 Rymarchyk, Jr. ..... F27B 3/205 373/76
2013/0032978 A1 2/2013 Glass

* cited by examiner

*Primary Examiner* — Scott R Kastler
*Assistant Examiner* — Michael Aboagye
(74) *Attorney, Agent, or Firm* — Brian W. Foxworthy; Robert R. Waters; Waters Law Group, PLLC

(57) ABSTRACT

A shield for injection lances in metal production furnaces facilitates the adjustment of the contents of the melt in the metal production furnace. The shield has an outer shell joined to an inner shell by a face plate. The outer shell and inner shell define a fluid chamber between them and the face plate has an inlet aperture and an exit aperture for coolant flow through the fluid chamber. The shield is sized and shaped to fit into or around an aperture in the wall of the furnace. The shield has apertures through it to facilitate introduction of additives to the melt in the metal production furnace.

16 Claims, 7 Drawing Sheets

INJECTION LANCE SHIELD FOR METAL PRODUCTION FURNACE

FIELD OF THE INVENTION

This invention relates to protecting injection lances, such as oxygen lances, in metal production furnaces. More specifically, this invention relates to an enclosure that seats into the wall of a metal production furnace and provides access apertures for injection lances while also shielding the lances from the high heat of the furnace.

BACKGROUND OF THE INVENTION

In metal production furnaces, such as electric arc furnaces, the furnace vessel has a hearth made from refractory materials at its bottom. The furnace walls surrounding the hearth may also be made from refractory materials, or they may be made from water cooled metal panels. Smelting material is placed in the furnace and melted. In electric arc furnaces, electrodes are lowered into the furnace into proximity with the smelting material, and the resulting electric arcs melt the material in the furnace. The refractory construction of the furnace hearth allows the hearth to withstand the temperatures required to melt the smelting materials. The resulting melt frequently comprises a layer of melted metal at the bottom covered by a layer of slag. The slag layer comprises the other, undesirable, constituents of metal ore or metal scrap melted in the furnace.

To control the content of the material in the furnace melt, other, additional material is added into the furnace environment. For example, the carbon content of iron melts is controlled to determine the type of steel produced. The additional material is added with gas jets directed into the melt. In some cases, particulate ingredients may be added. In situations in which it is desired to adjust the carbon content, oxygen jets are directed into the melt to form carbon dioxide and extract carbon from the melt. The jets are delivered with oxygen lances placed in the lower portion of furnace. The furnace walls have portals or holes left open in the walls down near the hearth, and injection lance shields, seat into these portals. The shields, more or less close the portal between the interior and exterior of the furnace, and have apertures in them for receiving the injection lances, allowing the jets from the lances to be directed toward the melts in the furnace.

In order for the gases and particulates from the lances to interact with the melt at the bottom of furnace, the portals in the walls of the furnace are located down near the melt. This means that the shields located in these portals are subjected to very high temperatures and highly corrosive or reductive environments. The shields protect the lances from the metal production environment of the furnace. The jets may even result in slag from the surface of the melt splashing up on the shields. When that happens, the slag may cool and collect on the shields.

The shields have different shapes and are made from different materials. Some shields are made from refractory material with apertures through them. Other shields are made from metal and water cooled. The water cooling function of shields utilizing water cooling is handled by many different configurations. Many water cooled shields rely on sets of complex passages which are difficult to manufacture and which may have locations of low fluid flow where heat is not adequately conducted away from the shield. Other shields are designed to accumulate a protective layer of slag from splash from the melt. However, those designs do not always conduct the heat away in a uniform manner and may develop hot spots in the features designed to accumulate the slag. Hot spots can lead to material altering temperatures at locations in the shield, with material failure being a possibility.

There remains a need for a shield that is simple in configuration and construction, and yet effectively conducts heat away from the surface exposed to heat, and that avoids hot spots in the exposed surface. Embodiments of the shield disclosed and claimed in the present application satisfy these needs.

RELEVANT ART

U.S. Published Patent Application 2007/0058689 A1 by Rymarchyk, J R. et al. is for a "FURNACE PANEL". In Rymarchyk, J R. et al., a water-cooled, bi-metal copper and steel furnace panel includes one or more passageways for enabling gaseous and/or particulate matter to be discharged into a furnace vessel through the panel. The passageways may support a metal treatment apparatus. The panel has a front plate made of copper and a rear plate made of steel. The front and rear plates are welded or otherwise joined to one another to define a water coolant passageway for cooling the front plate of the panel. An array of vanes is selectively securable to the inner face of the outer steel plate in any desired number and arrangement suitable to accommodate the gaseous/particulate matter discharge passageway(s) and the cooling requirements of the front plate.

U.S. Pat. No. 4,077,614 by Udo et al. is for a "STEELMAKING APPARATUS". A cold charge of steel scrap is melt cut and melted in an arc furnace provided with special oxygen-fuel burners by which rapid melting is promoted, the interior of the furnace being maintained under negative pressure by a fume evacuation and filtration means thereby to draw in secondary air from the outside atmosphere and, moreover, to increase the burner combustion efficiency. The arc furnace is provided with water cooling devices including a water-cooled ring, carbonaceous bricks, high-alumina ramming masses, and burner tiles in parts of the furnace wall and roof, particularly at wall parts where the burners are mounted, the wall above the slag line, and a roof part where an exhaust gas outlet is formed. A set of water frames is located in the wall of the furnace. One water frame fits in the wall of the furnace and has an aperture for receiving the other water frame. The latter water frame receives a burner which injects burning gas into the furnace. Water is pumped through the water frames to cool the water frames and the burner.

U.S. Published Application 2013/0032978 by Glass is for a "BURNER GLAND FOR AN ELECTRIC ARC FURNACE". Glass discloses a burner enclosure for use in locating a burner in a wall of an electric arc furnace. The burner enclosure includes a plurality of walls wherein each wall includes a serpentine cooling path therein and an inlet located proximal a first edge of each wall and an outlet located proximal a second edge of each wall. The walls are assembled into the burner enclosure such that an inlet of one wall can be connected by an elbow to an outlet of an adjoining wall to create a cooling fluid flow path through the entire burner enclosure to improve the performance of the burner in the burner enclosure and to improve the overall efficiency of the electric arc furnace.

U.S. Pat. No. 6,999,495 by Popenov et al. is for a "Method and apparatus for spatial energy coverage". In Popenov, a method and apparatus for increasing spatial energy coverage in a furnace is provided. The apparatus of the present invention includes a panel positioned at least partially into a sidewall of a furnace. The panel includes a plurality of openings for injecting a material through each of the openings at least partially during the same time period. The method of the present invention includes positioning the panel at least partially within the sidewall of a furnace. The method also includes injecting at least partially during the same time period, a primary combustion material, a secondary combustion material, and a particulate material, into the furnace.

As may be seen from the relevant art, there remains a need for a shield that is simple in configuration and construction, effectively conducts heat away from the surface exposed to heat, and that avoids hot spots in the exposed surface. Embodiments of the shield disclosed and claimed in the present application satisfy these and other needs.

SUMMARY FOR EMBODIMENTS OF THE INVENTION

A shield for metal production furnaces facilitates the adjustment of the contents of the melt in the metal production furnace. The shield has an outer shell joined to an inner shell by a face plate. The outer shell and inner shell define a fluid chamber between them and the face plate has an inlet aperture and an exit aperture for coolant flow through the fluid chamber. The shield is sized and shaped to fit into or around an aperture in the wall of the furnace. The shield has apertures through it to facilitate introduction of additives to the melt in the metal production furnace. This introduction may be by jet lances or other means.

Some embodiments of the shield may have a septum in the fluid chamber to divide the coolant flow through the fluid chamber. Some embodiments of the shield may have stiffening ribs on either the outer shell or the inner shell to provide additional structural strength. The septum and stiffening ribs may also act as heat transfer fins to conduct heat from the outer shell to the coolant fluid.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figure 1:
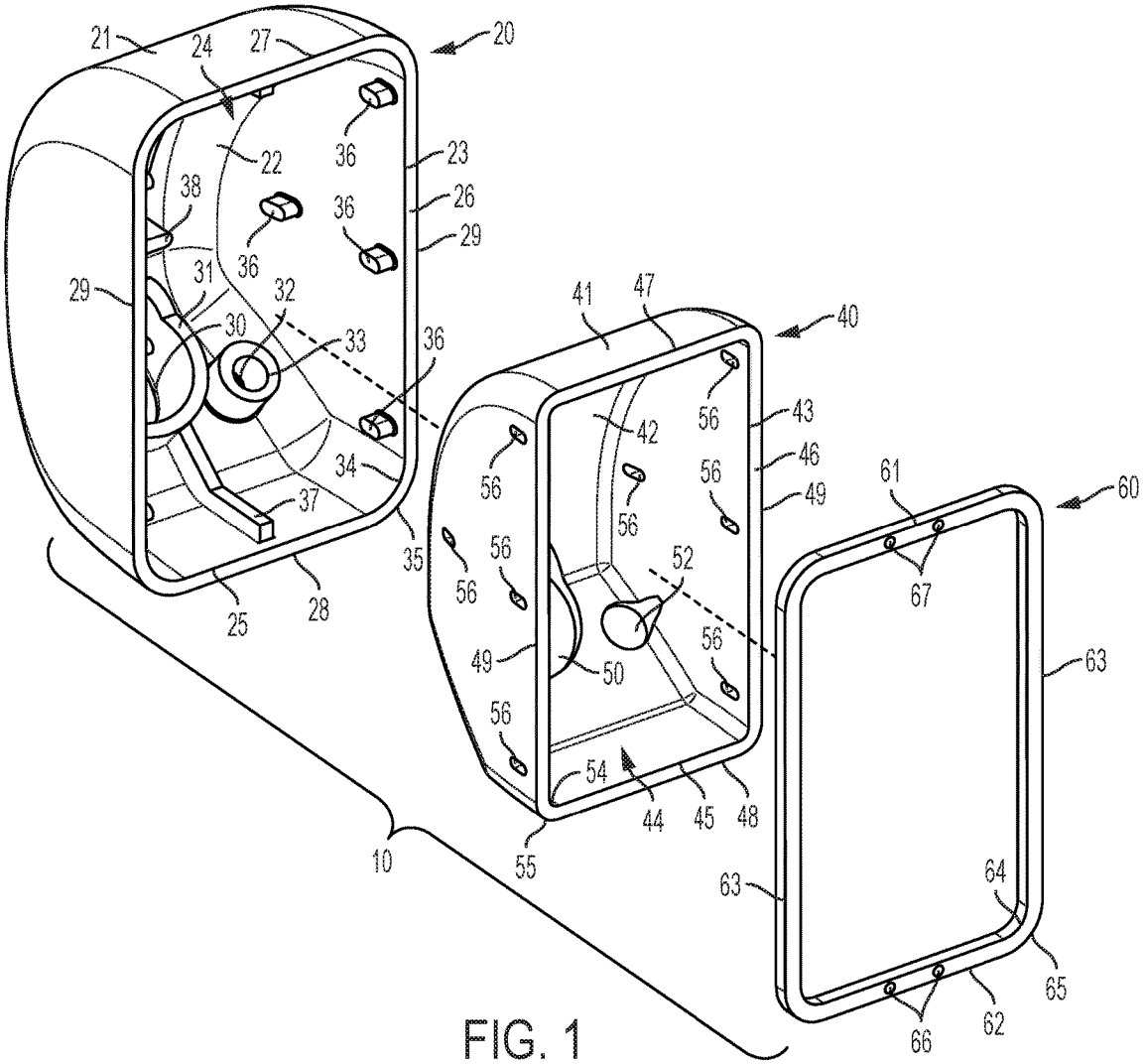
FIG. 1 is an exploded rear perspective view of an embodiment of a shield according to the present disclosure.

FIG. 1 is an exploded rear perspective view of an embodiment of a shield according to the present disclosure. Shield 10 comprises outer shell 20, inner shell 40, and face plate 60. Inner shell 40 fits into outer shell 20 and therefore they have similar overall shapes. Where outer shell 20 and inner shell 40 interface, they have matching geometries to seal, and face plate 60 also seals between outer shell 20 and inner 40.

Outer shell 20 is a domed plate having a convex surface 21 and concave surface 22 opposite each other and connected by a rim 23. The distance, or thickness, between convex surface 21 and concave surface 22 varies and outer shell 20 is thicker in some places than others. Concave surface 22 defines an interior space 24. Rim 23 of outer shell 20 defines an opening 25 into interior space 24 of outer shell 20. In the embodiment of FIG. 1, rim 23 presents a flat surface 26 and has a generally rectangular shape with a top 27, bottom 28, and opposing sides 29 sized to fit into an aperture in a furnace wall. Rim 23 has radii 34 and 35 at the corners where the sides meet. The surface contour and shape of rim 23 may vary according to applications such as the shape of the aperture in the furnace wall and whether rim 23 needs to accommodate an irregularity in the aperture, such as a bolt, etc.

Outer shell 20 has at least one aperture through it to accommodate an apparatus such as a gas lance. In the embodiment shown in FIG. 1, outer shell 20 has two apertures, 30 and 32. Apertures 30 and 32 are located toward the bottom area of the dome of outer shell 20 and given a downward direction. Apertures 30 and 32 are of different sizes to accommodate different apparatuses used to affect the melt content of a furnace. In the embodiment shown in FIG. 1, both apertures 30 and 32 have a boss 31 and 33, respectively, formed around them on concave surface 22 of outer shell 20.

As previously noted, outer shell 20 and inner shell 40 are similarly shaped. Still referring to FIG. 1, inner shell 40 is a domed plate having a convex surface 41 and concave surface 42 opposite each other and connected by a rim 43. Concave surface 42 defines an interior space 44. Rim 43 of inner shell 40 defines an opening 45 into interior space 44 of inner shell 40. In the embodiment of FIG. 1, rim 43 presents a flat surface 46 and has a generally rectangular shape with a top 47, bottom 48, and opposing sides 49 sized to fit into with rim 23 of outer shell 20. Rim 43 has radii 54 and 55 at the corners where the sides meet. The surface contour and shape of rim 43 may vary according to the shape of rim 23 of outer shell 20 which may vary according to applications such as the shape of the aperture in the furnace wall and whether rims 23 and 43 need to accommodate an irregularity in the aperture in the wall, such as a bolt, etc.

Figure 3:
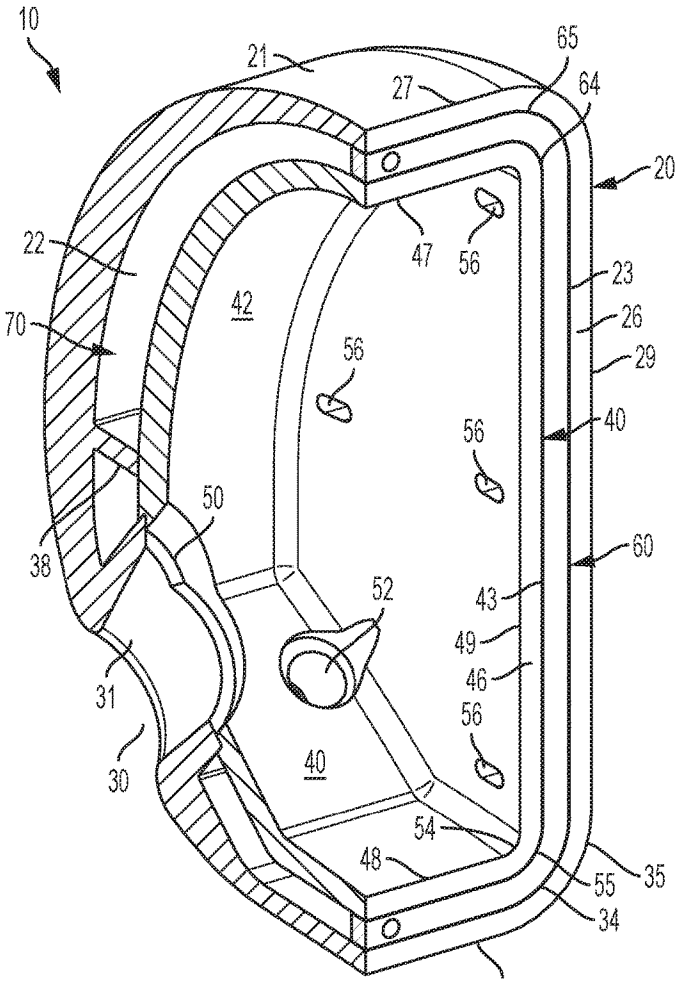
FIG. 3 is a rear perspective section view of an embodiment of shield according to the present disclosure, with a portion cut away for viewing.
Figure 5:
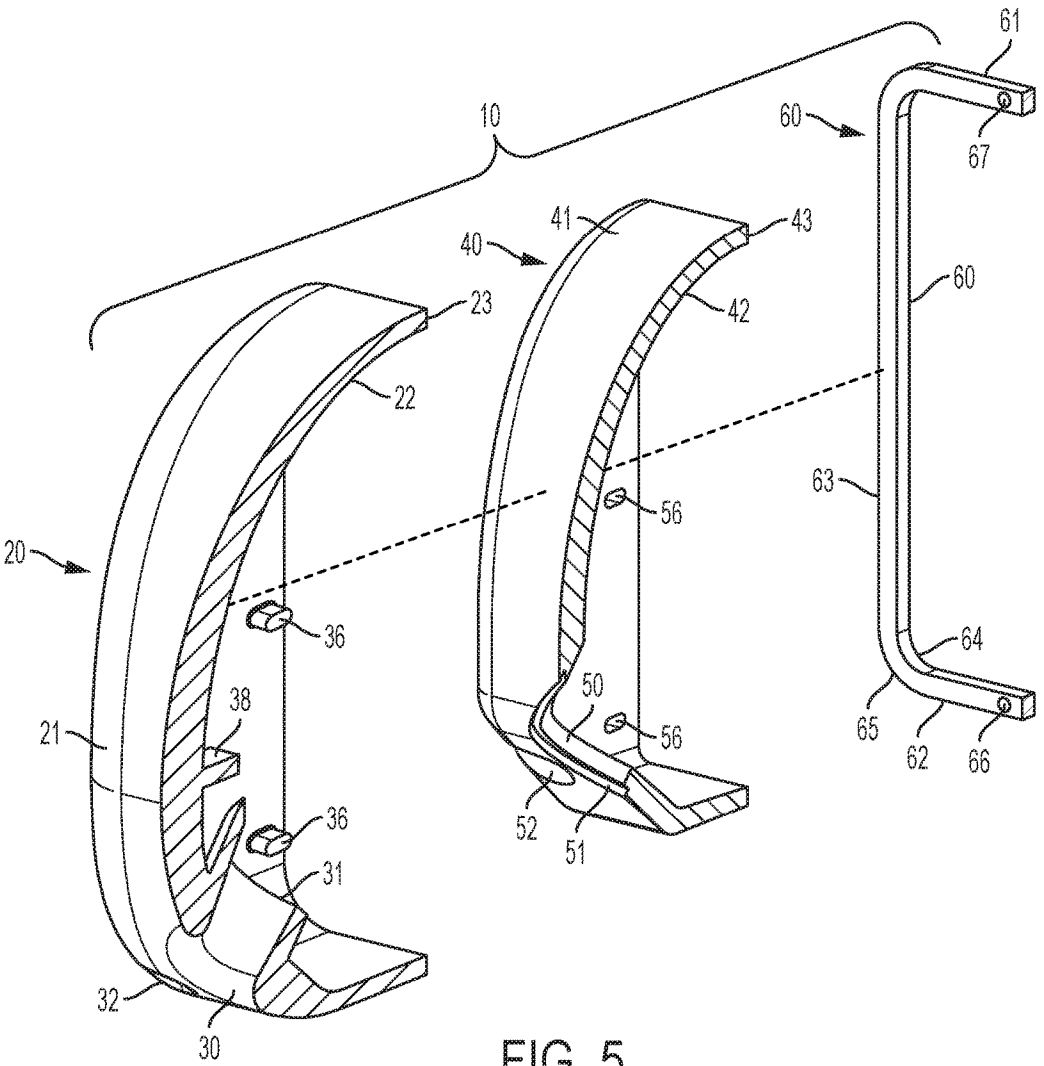
FIG. 5 is an exploded front perspective section view of an embodiment of a shield according to the present disclosure.
Figure 8:
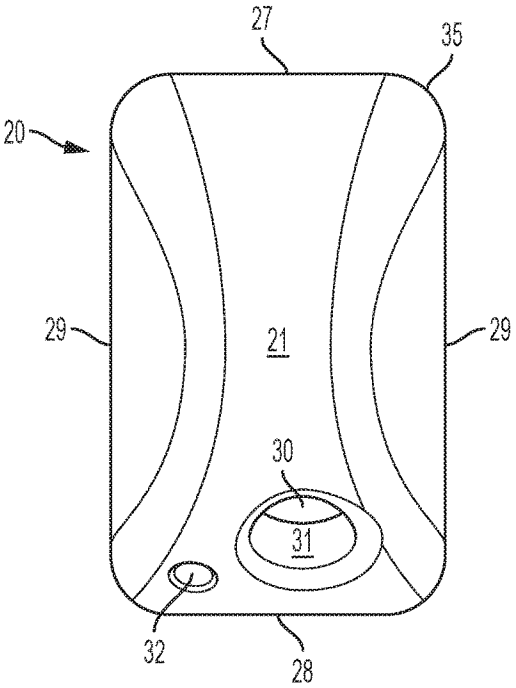
FIG. 8 is a front view of the outer shell of an embodiment of a shield according to the present disclosure.
Figure 7:
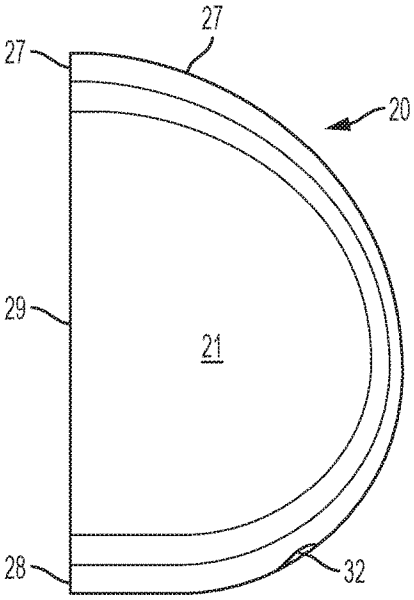
FIG. 7 is a side view of the outer shell of an embodiment of a shield according to the present disclosure.
Figure 9:
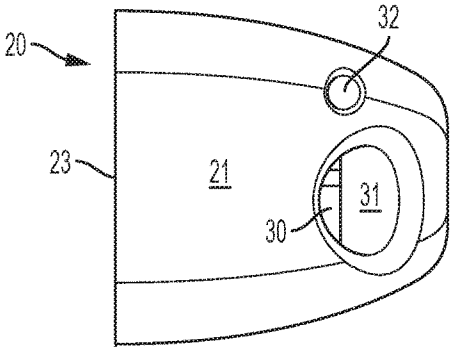
FIG. 9 is a bottom view of the outer shell of an embodiment of a shield according to the present disclosure.
Figure 12:
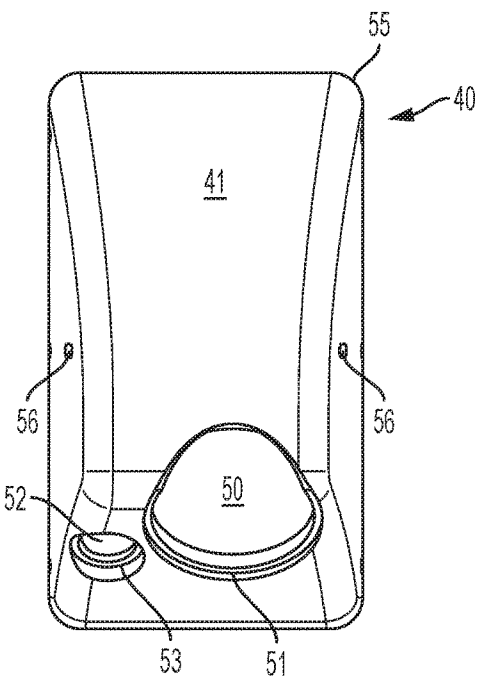
FIG. 12 is a rear view of the inner shell of an embodiment of a shield according to the present disclosure.
Figure 11:
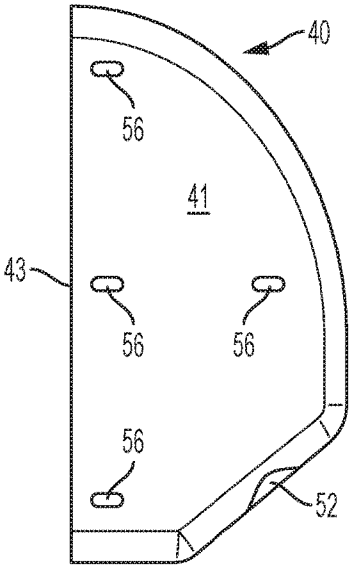
FIG. 11 is a side view of the inner shell of an embodiment of a shield according to the present disclosure.
Figure 13:
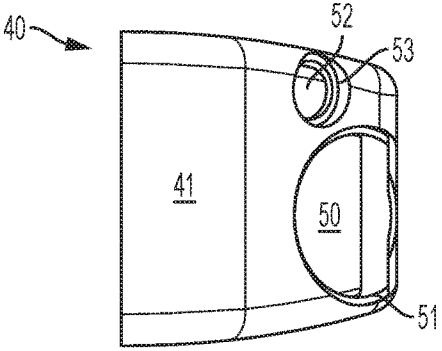
FIG. 13 is a bottom view of the inner shell of an embodiment of a shield according to the present disclosure.
Figure 10:
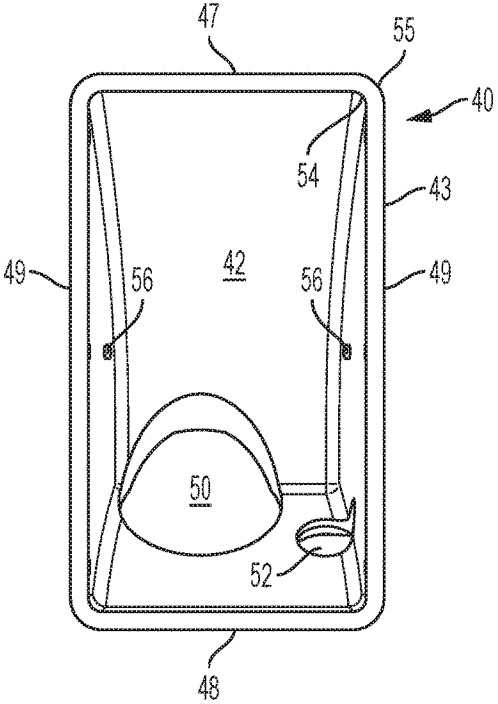
FIG. 10 is a rear view of the inner shell of an embodiment of a shield according to the present disclosure.

For each aperture in outer shell 20, inner shell 40 has an aperture through it to match. The matching apertures match for both location and size. In the embodiment shown in FIG. 1, inner shell 40 has two apertures, 50 and 52. Apertures 50 and 52 are located toward the bottom area of the dome of inner shell 40 and given a downward direction. As with apertures 30 and 32 of outer shell 20, apertures 50 and 52 of inner shell 40 are of different sizes to accommodate different apparatuses used to affect the melt content of a furnace. Referring to FIGS. 5, 12, and 13 both apertures 50 and 52 have a seat 51 and 53, respectively, formed around them on concave surface 42 of inner shell 40. When inner shell 40 is inserted into outer shell 20 for assembly, bosses 31 and 33 around apertures 30 and 32, respectively, match into seats 51 and 53 around apertures 50 and 52, respectively. FIG. 3 is a rear perspective section view of an embodiment of shield 10, and the seating of boss 31 into seat 51 is shown in FIG. 3.

Outer shell 20 may be joined to inner shell 40 around apertures 30, 32, 50, and 52 in any appropriate manner for the materials involved. The joining may be by welding, press fit, peening, rolling, etc. A leak proof seal is desired. Other embodiments, may have a single aperture, or more than the two apertures shown in the embodiments shown in the figures.

Figure 4:
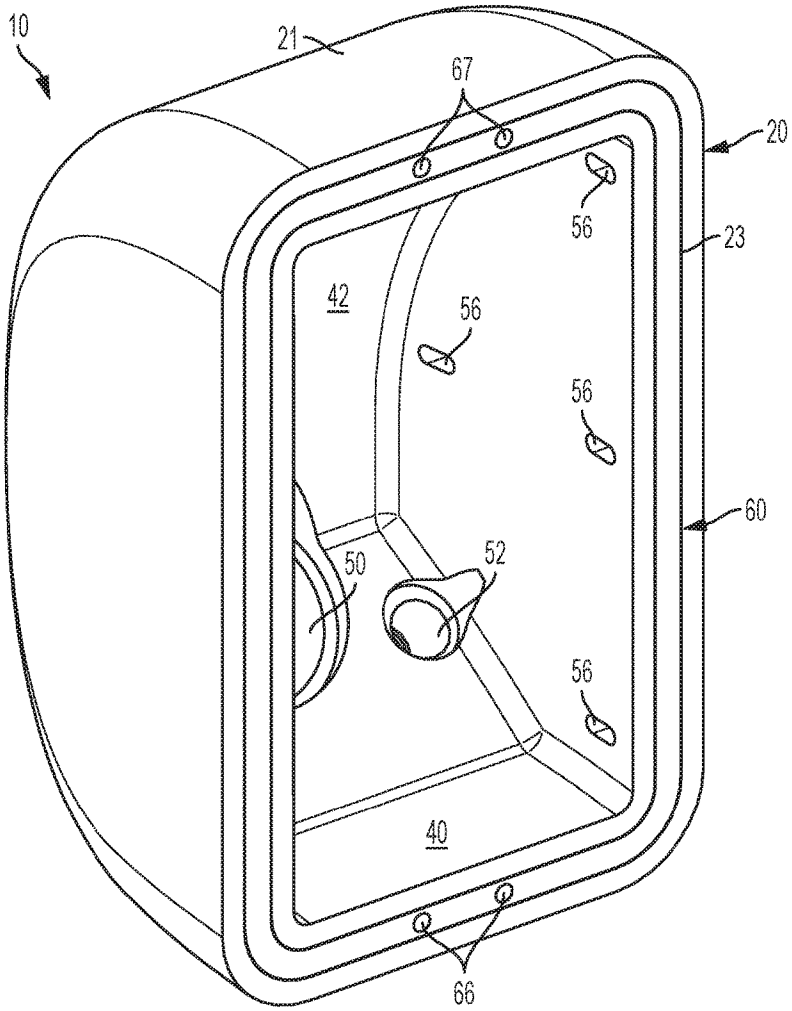
FIG. 4 is a rear perspective view of an embodiment of shield according to the present disclosure.

In the embodiment of shield 10 shown in FIG. 1, rim 23 of outer shell 20 and rim 43 of inner shell 40 are rectangular with radii at their corners. When outer shell 20 and inner shell 40 are fit together, rims 23 and 43 define a rectangular opening. Face plate 60 is rectangular with a top 61, bottom 62, and opposing sides 63. Face plate 60 has radii 64 and 65 at the corners and is wide enough to close the gap between outer shell 20 and inner shell 40. Although the embodiment of face plate 60 shown is rectangular, it could be any shape needed to fill the gap between outer shell 20 and inner shell 40. FIG. 4 is a rear perspective view of an embodiment of shield 10. FIGS. 3 and 4 show outer shell 20, inner shell 40, and face plate 60 assembled. The joining of rim 23, rim 43, and face plate 60 may be by welding, press fit, peening, rolling, etc. A leak proof seal is desired.

Face plate 60 has fluid inlet apertures 66 and fluid exit apertures 67. Fluid chamber 70 is shown in FIG. 3. Fluid chamber 70 is created by the space between outer shell 20 and inner shell 40. To keep shield 10 at a temperature that maintains its structural integrity, fluid is pumped into inlet apertures 66 through fluid chamber 70 to exit apertures 67 where the fluid leaves shield 10. FIG. 3 also shows the varying thickness of outer shell 20.

In the embodiment of shield 10 shown in FIG. 1, assembly studs 36 are positioned around the interior of outer shell 20 on concave surface 22. Several assembly studs 36 are proximal to rim 23. Assembly studs 36 are used to assemble shield 10. Inner shell 40 has assembly apertures 56 in equal number to assembly studs 36 on outer shell 20 and the locations of assembly studs 36 and assembly apertures 56 match each other. Assembly studs 36 and assembly apertures 56 may also be seen in the embodiments shown in FIGS. 2 and 5, while assembly studs 36 and assembly apertures 56 may be seen separately in the embodiments shown in FIG. 6, and FIGS. 3, 4, 10, and 11.

When outer shell 20 and inner shell 40 are assembled to each other, assembly studs 36 align with, and insert into, assembly apertures 56. Assembly studs 36 may be joined to inner shell 40 in any appropriate manner for the materials involved. The joining may be by welding, press fit, peening, etc.

Figure 2:
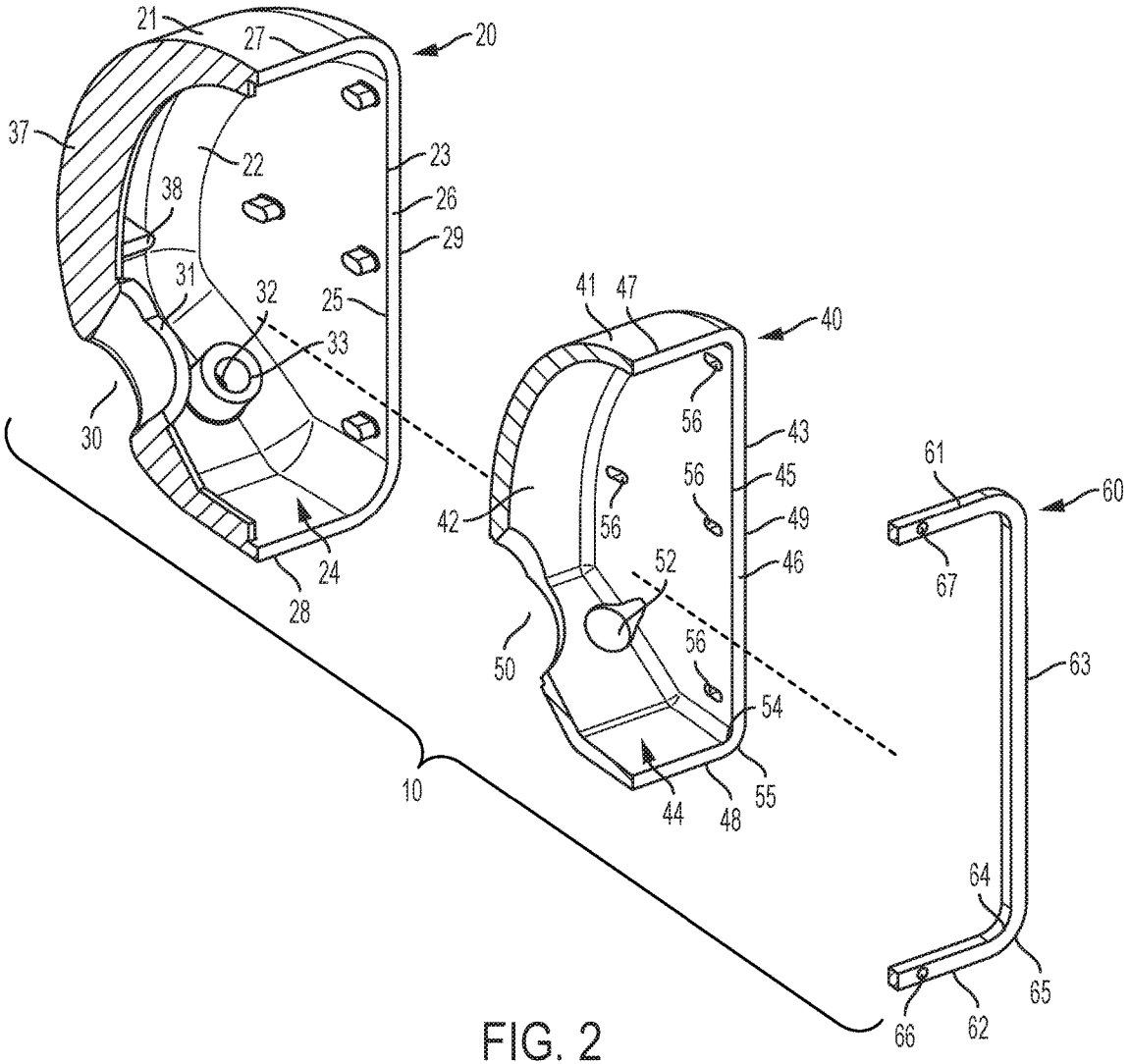
FIG. 2 is an exploded rear perspective section view of an embodiment of a shield according to the present disclosure, with a portion cut away for viewing.
Figure 6:
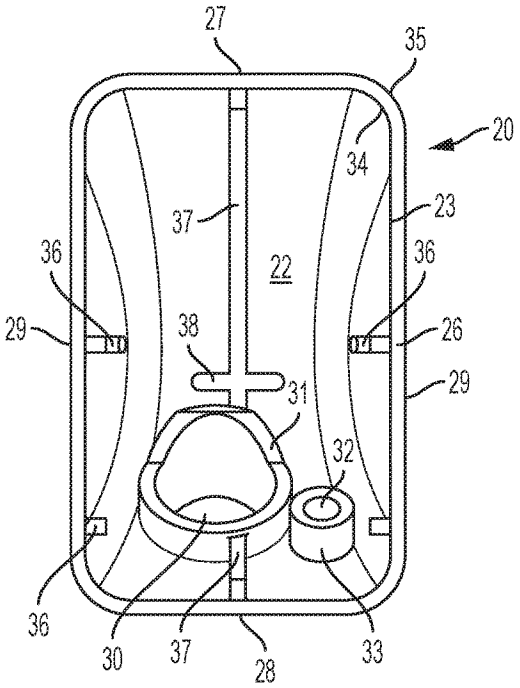
FIG. 6 is a rear view of the outer shell of an embodiment of a shield according to the present disclosure.

In the embodiments of shield 10 shown in FIGS. 1, 2, and 6, central septum 37 extends from concave surface 22 of outer shell 20. The section plane of FIG. 2 passes through septum 37. Septum 37 runs the length of concave surface 22 from the top of concave surface 22 to boss 31 and then extends from boss 31 down to the bottom of concave surface 22. In the embodiment shown in FIG. 2, septum 37 contacts inner shell 40. Depending on the particular embodiment, septum 37 may serve several purposes. It can divide fluid chamber 70 into two longitudinal chambers to create a directed flow path between inlet aperture 66 and exit apertures 67 and to avoid eddies where the flow of fluid may stall. Septum 37 can provide additional structural strength to outer shell 20 and shield 10. Septum 37 can also act as a cooling fin, drawing heat from the body of outer shell 20 and providing additional surface area to transfer heat to the fluid.

In the embodiments of shield 10 shown in FIGS. 1, 2, and 6, lateral stiffeners 38 extend from concave surface 22 of outer shell 20 and laterally from septum 37. FIGS. 3 and 5 show lateral stiffeners 38 with septum 37 sectioned out of the view. Lateral stiffeners 38 provide added structural strength to outer shell 20 and may abut inner shell 40. Lateral stiffeners 38 may also act as heat transfer fins, drawing heat from the body of outer shell 40 and providing additional surface area for heat transfer.

FIGS. 6, 7, 8, and 9 show four plan views of outer shell 20. In the embodiment of those figures, the domed shape of outer shell 20 comprises several curved surfaces combined together to form the dome. The dome of outer shell 20 terminates in a rectangular rim 23.

FIGS. 10, 11, 12, and 13 show four plan views of inner shell 40. In the embodiment of those figures, the domed shape of inner shell 40 comprises several curved surfaces combined together to form the dome. The dome of inner shell 40 terminates in a rectangular rim 43. Inner shell 40 is sized and shaped to fit within outer shell 20.

Figure 16:
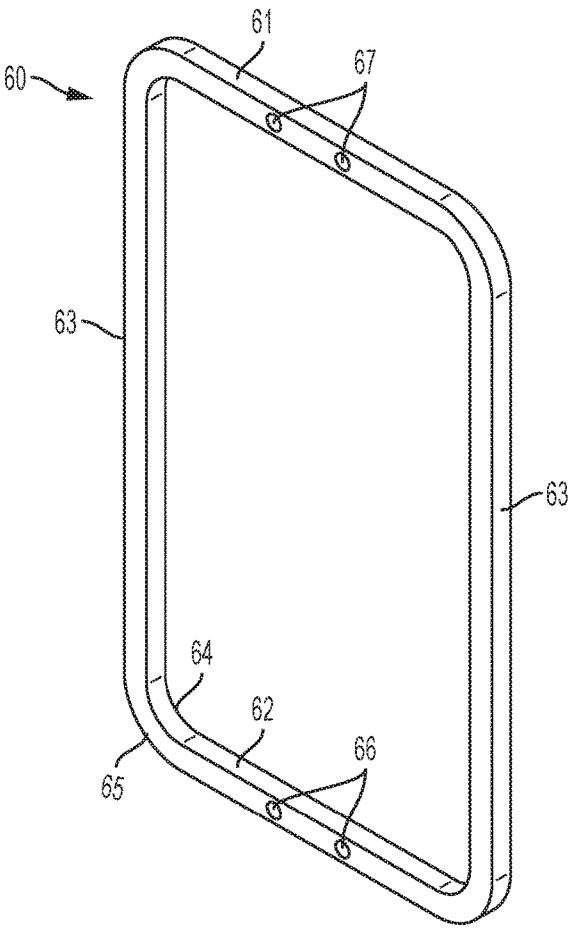
FIG. 16 is a perspective view of the face plate of an embodiment of a shield according to the present disclosure.
Figure 15:
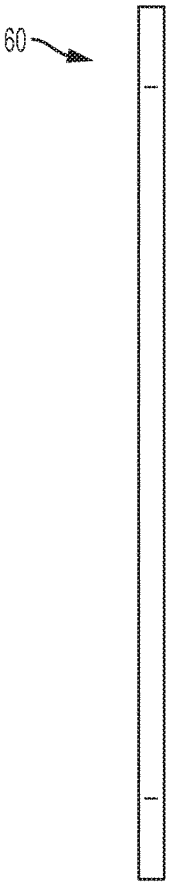
FIG. 15 is a side view of the face plate of an embodiment of a shield according to the present disclosure.
Figure 14:
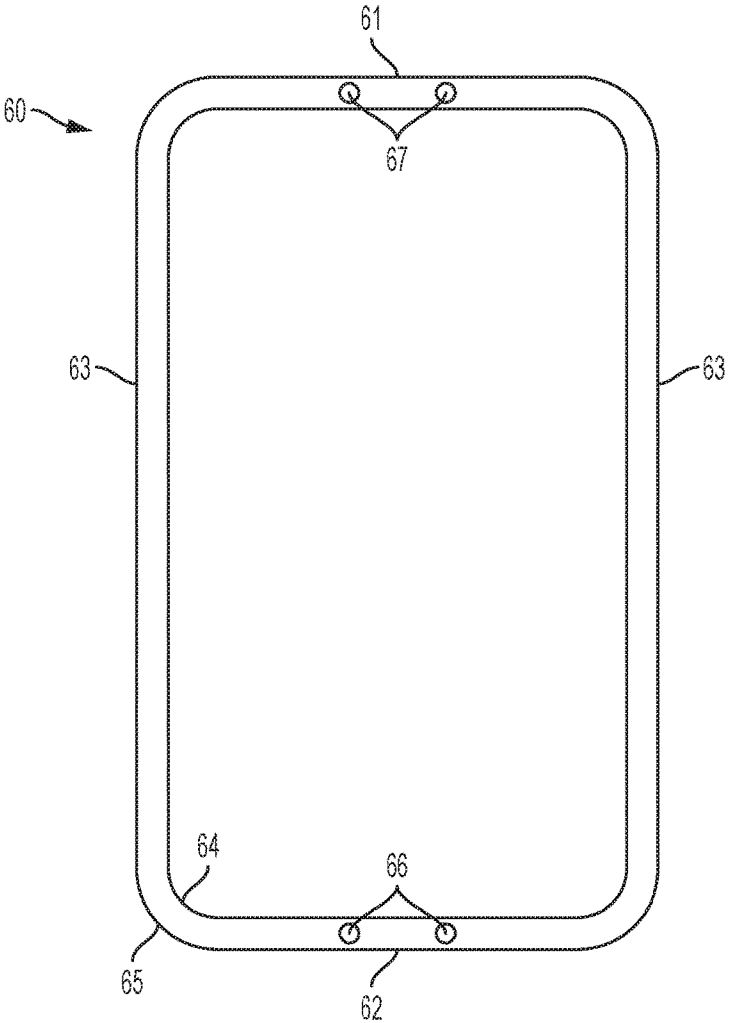
FIG. 14 is a plan view of the face plate of an embodiment of a shield according to the present disclosure.

FIGS. 14, 15, and 16 show four plan views of face plate 60. In the embodiment of those figures, face plate 60 is rectangular, having a top 61, bottom 62, and opposing sides 63. At one end, face plate 60 has inlet apertures 66, and at its other end, it has exit apertures 67. Face plate 60 is sized and shaped to fit between rims 23 and 43 of outer shell 20 and inner shell 40, respectively, when shield 10 is assembled from outer shell 20, inner shell 40, and face plate 60. Although, the embodiments shown in the figures have two inlet apertures 66 and two exit apertures 67, more apertures could be added for increased flow, or increased control of flow. It is also possible that a single aperture could be used at either position.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

We claim:

1. A shield for accessing an interior of a furnace, the furnace having an aperture in its wall, the shield comprising:

an outer shell, an inner shell fitted into said outer shell, and a face plate joining said outer and inner shells;

said outer shell comprising a convex external surface and a concave internal surface, said external surface and internal surface of said outer shell terminating in an external rim, said external rim being sized and shaped to fit the aperture of the furnace wall;

said inner shell comprising a convex internal surface and a concave external surface, said internal surface and external surface of said inner shell terminating in an internal rim, said internal rim sized and shaped to fit within said external rim of said outer shell;

said face plate joining said external rim to said internal rim with said convex internal surface of said inner shell and said concave internal surface of said outer shell facing each other and defining a fluid chamber for coolant flow between them, said face plate comprising an aperture for coolant entry and an aperture for coolant exit;

said outer and inner shells each having an aperture through each, the aperture in said outer shell being aligned with the aperture in said inner shell, the aperture in one of said outer shell and said inner shell having a boss around it on the internal surface of that shell and the aperture in the other of said outer shell and said inner shell having a seat around it on the internal surface of that shell, said seat receiving said boss and sealing said fluid chamber.

2. The shield of claim 1, wherein:

said outer and inner shells each has an equal plurality of apertures through it;

each aperture in said outer shell being paired with a respective aperture in said inner shell, a first aperture in each pair of apertures having a boss around it on the internal surface of its respective shell, a second aperture in each pair having a seat around it on the internal surface of its respective shell, each said seat receiving a respective boss and sealing said fluid chamber.

3. The shield of claim 1, wherein:

said outer rim comprises a recess around its internal circumference, said face plate being seated in said recess.

4. The shield of claim 1, wherein:

said face plate comprises a plurality of apertures for coolant entry and a plurality of apertures for coolant exit.

5. The shield of claim 1, further comprising:

a septum extending from said concave internal surface of said outer shell into said fluid chamber, said septum oriented generally to run from said inlet aperture to said exit aperture and to divide the flow of coolant.

6. The shield of claim 1, further comprising:

a stiffening rib extending from said concave internal surface of said outer shell into said fluid chamber.

7. The shield of claim 1, wherein:

the aperture in the furnace wall has a frame around it, the frame extending into the interior of the furnace; and, the shield mounts to the frame around the aperture in the furnace wall.

8. A shield for accessing an interior of a furnace, the furnace having an aperture in its wall, the shield comprising:

a first domed plate having a convex surface and a concave surface, said convex surface and said concave surface of said first domed plate being joined by a single side forming a first rim, said first rim being shaped and sized to fit the aperture in the furnace wall;

a second domed plate having a convex surface and a concave surface, said convex surface and said concave surface of said second domed plate being joined by a single side forming a second rim, said second rim being shaped and sized to fit in within said first rim, said second domed plate being located within said first domed plate, said convex surface of said second domed plate facing said concave surface of said first domed plate, said first domed plate and said second domed plate defining a fluid chamber for coolant flow between them; and, a face plate joining said first rim and said second rim, said face plate having a coolant inlet aperture into said fluid chamber and a coolant exit aperture from said fluid chamber;

said first domed plate having an exterior aperture through it and said second domed plate having an interior aperture through it, said exterior aperture and interior aperture being aligned and sealed together around their perimeters to seal said fluid chamber.

9. The shield of claim 8, wherein:

a first one of said exterior aperture or said interior aperture has a boss around it facing a second one of said exterior aperture or said interior aperture and said second one of said exterior aperture or said interior aperture has a seat around it facing said first one of said exterior aperture or said interior aperture, said seat receiving said boss to seal said fluid chamber.

10. The shield of claim 8, wherein:

said first domed plate and second domed plate each has an equal plurality of apertures through it;

each aperture in said first domed pate being paired with a respective aperture in said second domed plate each pair of apertures being sealed to each other around their perimeters to seal said fluid chamber.

11. The shield of claim 10, wherein:

a first aperture in each pair of apertures has a boss around it facing the other domed plate and the second aperture in each pair has a seat around it facing the domed plate of the first aperture, each said seat receiving a respective boss and sealing said fluid chamber.

12. The shield of claim 8, wherein:

said first rim comprises a recess around its internal circumference, said face plate being seated in said recess.

13. The shield of claim 8, wherein:

said face plate comprises a plurality of apertures for coolant entry and a plurality of apertures for coolant exit.

14. The shield of claim 8, further comprising:

a septum extending from said concave surface of said first domed plate into said fluid chamber, said septum oriented generally to run from said inlet aperture to said exit aperture and to divide the flow of coolant.

15. The shield of claim 8, further comprising:

a stiffening rib extending from said concave surface of said first domed plate into said fluid chamber.

16. The shield of claim 8, wherein:

the aperture in the furnace wall has a frame around it, the frame extending into the interior of the furnace; and, the shield mounts to the frame around the aperture in the furnace wall.

* * * * *